United States Patent [19]

Kerttula

[11] Patent Number: 4,919,760

[45] Date of Patent: Apr. 24, 1990

[54] WEB FORMER FOR A PAPER MACHINE

[75] Inventor: Reima Kerttula, Charlotte, N.C.

[73] Assignee: Valmet Paper Machinery Inc., Finland

[21] Appl. No.: 218,833

[22] Filed: Jul. 13, 1988

[30] Foreign Application Priority Data

Jul. 13, 1987 [FI] Finland ..... 873076

[51] Int. Cl.[5] ..... D21F 1/36

[52] U.S. Cl. ..... 162/300; 162/301; 162/306; 162/308; 162/312

[58] Field of Search ..... 162/300, 301, 308, 312, 162/306, 203, 208

[56] References Cited

U.S. PATENT DOCUMENTS 4,523,978 6/1985 Pullinen ..... 162/301 X 4,686,004 8/1987 Fujiwara .

*Primary Examiner*—Peter Chin

*Assistant Examiner*—Thi Dang

*Attorney, Agent, or Firm*—Steinberg & Raskin

[57] ABSTRACT

A web former for a paper machine having a lower-wire loop which forms an initial single-wire part of a dewatering zone. The former also includes a top-wire unit which includes an upper wire which forms a twin-wire dewatering zone together with the lower wire. The former also includes a first forming roll in a direction of web travel that is provided with an open hollow face and is fitted inside the upper-wire loop. The twin-wire forming zone begins in conjunction with the first forming roll. There is a forming shoe inside the lower-wire loop which is provided with a curved deck that guides the lower-wire loop. The former includes a second forming roll fitted inside the upper wire loop and situated after the forming shoe. A device for collecting water is provided in the former and operates without any external suction source, with dewatering being based upon kinetic energy of water that is being removed and/or upon gravity.

27 Claims, 2 Drawing Sheets

WEB FORMER FOR A PAPER MACHINE

BACKGROUND OF THE INVENTION

The present invention concerns a web former for a paper machine. This former comprises a lower-wire loop situated in conjunction with a head box of the paper machine and forming a single-wire, preferably substantially horizontal initial portion of a dewatering zone, on which water is removed through the lower wire by means of dewatering members and out of the web that is being formed. The former also comprises a top-wire unit which includes an upper wire guided by guide and web-forming rolls. The upper wire, together with the run of the lower wire, form a twin-wire dewatering zone in which the dewatering takes place substantially upwardly through the upper wire.

The former further comprises a first forming roll provided with an open hollow face and fitted inside the loop of the upper wire, the twin-wire forming zone beginning in connection with the first forming roll, and the twin-wire forming zone being curved upwardly over a certain sector of this forming roll. Moreover, the former additionally comprises a forming shoe which is situated after the forming roll and fitted inside the lower-wire loop, which guides the twin-wire dewatering zone. The forming shoe has a curved deck for guiding the lower-wire loop, with a center or centers of curvature of the deck being situated at the side of the lower-wire loop.

In prior art, twin-wire formers that are commonly used, so-called full-gap formers, the pulp is fed onto the wire part as a dilute suspension, after which the dewatering of the pulp forcibly begins directly or after a very short single-wire portion, in both directions or in the same direction as in the single-wire portion. A considerable proportion of the fillers and fines added to the pulp are also removed along with the water in this fashion. This naturally lowers the quality of the paper web and in particular deteriorates the properties that are supposed to be obtained for the paper web by means of the fillers. Simultaneous and intensive dewatering in two directions also readily causes weakening of the middle portion of the web which results in low internal bond strength.

In view of avoiding the drawbacks noted above, the Valmet Finnish Patent No. 50,648 suggests a twin-wire forming which is characterized by the initial single-wire part of the wire portion being sufficiently long so that as the dewatering gently takes place in this initial part, the pulp web has time to reach a degree of coating before the twin-wire portion so that the fibers can no longer be displaced relative to each other to a significant extent. The twin-wire portion is guided by a dewatering roll or by a dewatering box and is curved downwardly so that water is removed in this curved portion, in particular by the effect of a pressure zone produced by centrifugal force and by the tensioning between the wires through the upper wire and in the direction opposite to the direction in the single-wire initial portion. The primary objective therein is to reduce the removal of additives in the pulp web, such as the fillers as well as the fines in the web, and to also increase the internal bond strength of the paper to be produced.

Such prior-art, twin-wire formers in which no stationary dewatering members are used, usually have poor formation. It is not possible to produce such pulsations of the dewatering pressure to improve formation by means of these prior art devices. A further drawback has been that these formers have not included the possibility of regulating the ratios of the water quantities removed through the upper wire and through the lower wire.

Twin-wire formers are also known in the prior art, in which the dewatering is based almost exclusively on the use of stationary dewatering members. However, these formers involve the drawbacks of poor retention as well as rapid wear of the wires and high consumption of power.

In recent years, modernizations of fourdrinier machines have become common in which one or several top-wire units have been placed above the fourdrinier unit. By means of these top-wire units dewatering is produced upwardly, with the objective of both increasing the dewatering capacity and improving the formation and retention. On the other hand, an increased dewatering capacity permits an increased running speed of the paper machine. One objective has been to permit a lowering of the consistency of the pulp fed out of the head box, if necessary, which has favorable effects in and of itself. In some cases, old slow newsprint machines have been modernized to board machines by means of the top-wire units noted above, which produce thick qualities and require a high dewatering capacity without increasing the speed of the machine.

With respect to the prior art related to the present invention, reference is made to the following patents and patent applications: FI Pat. No. 80,648; FI patent application No. 820,742 (corresponding to U.S. Pat. No. 4,614,566); FI patent application No. 851,650; FI patent application No. 3240/70; FI patent application No. 822,705; U.S. Pat. No. 4,517,054; and U.S. Pat. No. 3,726,758.

SUMMARY OF THE INVENTION

Thus, it is an object of the present invention to further develop and improve the twin-wire formers noted above and which have an essential common feature of an initial single-wire portion of a forming zone after a slice in the head box, in which dewatering takes place relatively gently downwardly, e.g. in accordance with the main principles described in the Valmet Finnish Patent No. 50,648.

It is also an object of the present invention to provide a twin-wire former in which costly water-collecting systems provided with suction, such as so-called Auto Slice devices ("Auto Slice" TM of Beloit Corp.) are not required in the top-wire unit thereof.

It is an additional object of the present invention with respect to the above, to provide a twin-wire former which preferably provides suitable space and a suitable place for locating water-collecting devices operating without suction.

It is a further object of the present invention to provide a twin-wire former in which a forming shoe that it utilized does not have to be raised to an especially great height, and the forming shoe can be situated, preferably directly, on an existing frame construction which maintains cost of renewal of a former at a reasonable level.

These and other objects are attained by the present invention which is directed to a web former for a paper machine comprising a lower wire loop forming an initial, single wire part of a dewatering zone on which water is removed through the lower wire out of a web being formed by at least one dewatering member, and an upper wire unit including an upper wire loop guided by guide rolls and a web-forming roll. The upper and lower wires form a twin-wire part of the dewatering zone in which dewatering takes place substantially upwardly through the upper wire, while the web-forming roll constitutes a first roll in a direction of web run, is provided with an open hollow face, and is fitted inside the upper wire loop.

The twin-wire dewatering zone part begins at the first forming roll and curves upwardly over a sector of this roll. A forming shoe is fitted inside the lower wire loop and after the first forming roll in the web run direction, and guides the twin-wire dewatering zone part. The forming shoe has a curved deck for guiding the lower wire loop, with a center or centers of curvature thereof situated on a side of the lower wire loop.

The former also includes a second forming roll fitted inside the upper wire loop and after the forming shoe in the web run direction, and guiding the twin-wire part over a sector thereof. A lowest point of the sector is situated at a lower level than a level of the initial, single-wire dewatering part. A guide roll is situated inside the lower wire loop after the second forming roll and guides the twin-wire part over a sector thereof to substantially the level of the initial, single-wire dewatering zone. Means for collecting water are fitted inside the upper wire loop and between the forming shoe and the second forming roll. Such means operate without any external suction source, and the water collecting thereof is based upon kinetic energy of water being removed and/or gravity.

Furthermore, the twin-wire part is arranged over the first and second forming rolls and the forming shoe therebetween, to effect dewatering in two directions over the sector of the first forming roll through both the upper and lower wires, and both upwardly and downwardly over the curved deck of the forming shoe. Furthermore, the twin-wire part is arranged over the respective rolls and shoe to reverse principle dewatering direction of the shoe over the sector of the second forming roll, with dewatering pressure being increased thereat. This takes place after the initial dewatering through the lower wire on the initial single-wire zone to an appropriate extent.

The initial single-wire part may be substantially horizontal, while the curved deck of the forming shoe may be hollow-faced. The twin-wire part and the forming shoe may be arranged with respect to one another to effect dewatering substantially upwardly at the curved, forming shoe deck, with the twin-wire part and second forming roll being arranged with respect to one another to effect dewatering substantially downwardly at the sector thereof.

In view of achieving the objects noted above and avoiding the drawbacks discussed above, the present invention is principally characterized by the web former comprising a combination of parts fitted to be jointly operative as follows:

In addition to the first forming roll noted above, the former includes a second forming roll situated inside the upper-wire loop and fitted after the forming shoe provided with a hollow-faced deck, the second forming roll guiding the twin-wire forming zone over a certain sector thereof. A lowest point of this sector is situated at a lower level than a level of the initial single-wire part;

After the second forming roll, the joint run of the wires is brough back to substantially the level of the initial single-wire part by the deflecting sector of the guide roll situated inside the lower-wire loop;

Between the forming shoe and the second guide roll, water collecting means are used which are fitted inside the upper-wire loop, and which operate without any external suction source and with dewatering being based upon the kinetic energy of the water that is being removed and/or upon gravity; and The joint run of the wires situated within the area of the forming rolls and the forming shoe placed between the same, is arranged so that after the initial dewatering has taken place to an appropriate extent through the lower wire on its initial single-wire part, the dewatering takes place on the twin-wire dewatering zone first on the sector of the first open forming roll in two directions through both of the wires, whereupon within the area of the curved deck of the following forming shoe, the dewatering takes place both upwardly and downwardly, preferably substantially upwardly through the upper wire, and thereupon the principle dewatering direction is reversed within the area of the second forming roll while at the same time increasing the dewatering pressure.

According to the invention, a forming shoe is advantageously used which is fitted inside the lower-wire loop so that the horizontal tangential plane of the twin-wire zone is situated in a middle area of the hollow-faced deck of the forming shoe. In such a way, the maximum difference in height between the hollow-faced deck of the forming shoe and the plane of the single-wire initial part can be maintained relatively small, as a rule less than about 400 mm. Under these circumstances, the forming shoe can be situated upon the original frame of the fourdrinier former without any substantial additional constructions.

According to the invention, when the deflecting sector of the second forming roll which is situated inside the upper-wire loop and which guides the joint run of the wires is situated at a lower level than a plane of the initial single-wire portion of the forming zone, a sufficient "depth" is obtained between the second forming roll and the preceding forming shoe for the water collecting means operating without external suction. Such "depth" can be increased by shortening the radius of the forming shoe even to two meters and by raising the forming shoe at the same time.

In the present application, being curved upwardly and downwardly means an alteration of the direction of the run of the wires and of the web upwardly or downwardly.

The former in accordance with the present invention is particularly well suited for the above modernizations of fourdrinier formers.

BRIEF DESCRIPTION OF THE DRAWINGS

The present invention will be described below in greater detail below with reference to certain exemplary embodiments thereof illustrated in the accompanying figures, and to which the present invention is by no means intended to be strictly confined. In the drawings.

DESCRIPTION OF THE PREFERRED EMBODIMENTS

Figure 1:
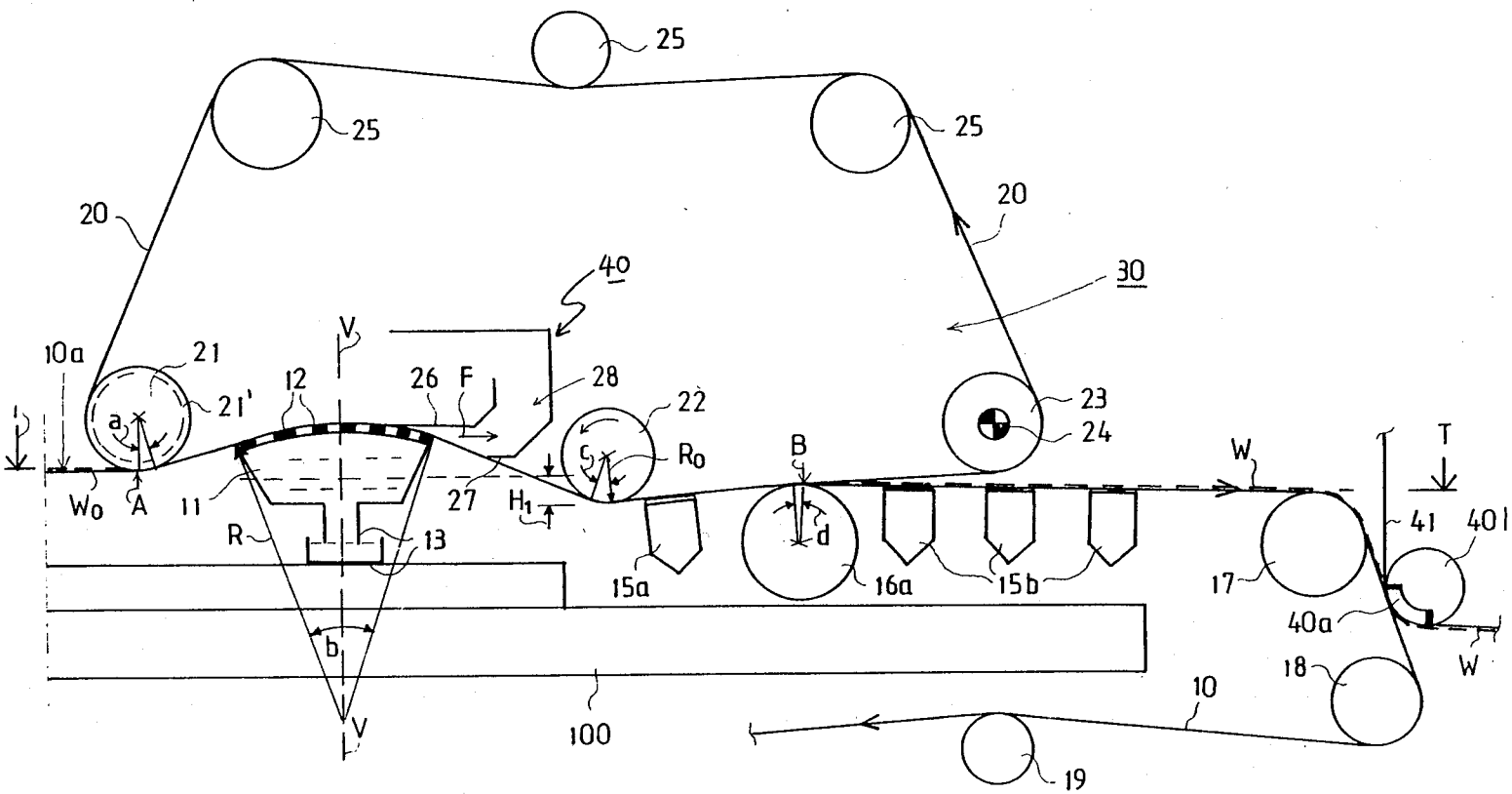
FIG. 1 is a schematic side view of a first embodiment of a twin-wire former in accordance with the present invention.
Figure 2:
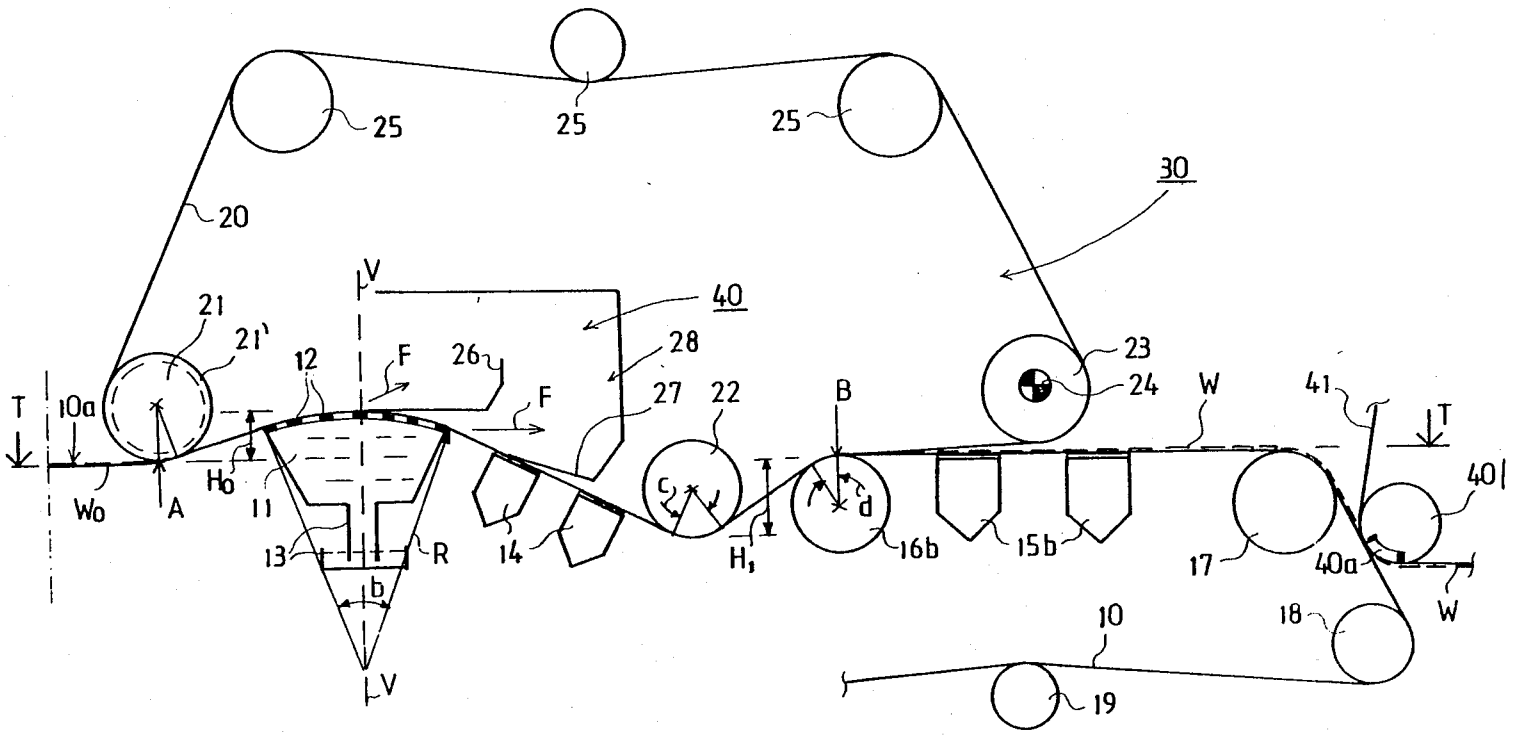
FIG. 2 is a schematic side view of an alternative embodiment of the present invention.

According to FIGS. 1 and 2, a former of a paper machine provided with a fourdrinier wire 10 is preferably renewed as a twin-wire former. An upper plane of the wire of the original fourdrinier former is denoted by T—T. The former comprises a frame 100 of the old wire part (FIG. 1), dry suction boxes 15*a* and/or 15*b* which were included in the original wire part, a wire drive roll 17 and a wire guide roll 18, as well as guide rolls 19 which guide a lower run of the wire 10 (only certain of these guide rolls 19 are illustrated, for purposes of clarity).

In conjunction with modernization of a fourdrinier former, a forming shoe 11 provided with a curved ribbed deck 12 is placed on the existing frame portion 100, the interior space in this forming shoe 11 being connected to a barometric leg 13 or to any other corresponding source of negative pressure. The curved deck 12 of the forming shoe 11 may be hollow-faced.

The top-wire unit 30 includes a frame part (not illustrated), to which the various respective parts are affixed. A run of an upper-wire loop 20 is guided, from a beginning A of the twin-wire zone by a hollow-faced 21', relatively open forming roll 21, and then by the curved hollow-faced deck 12 of the above-noted forming shoe 11, and further by a second forming roll 22. The twin-wire dewatering zone ends at a guide roll 16*a* (FIG. 1), 16*b* (FIG. 2), or soon thereafter.

Upper guide rolls of the upper wire 20 are denoted by reference numerals 25. The second forming roll 22 is arranged inside a loop of the upper wire 20 and after the forming shoe 11 in a direction of web travel. On a sector c of the second forming roll 22, the twin-wire zone is deflected upwardly. The second forming roll 22 is followed by the guide roll 16*a*;16*b* which is fitted inside the loop of the lower wire 10 and which guides the wires 10, 20 which are turned downwardly on a sector d of the second forming roll 22 to coincide with the plane T—T of the lower wire 10.

Novel features of the present invention include, e.g., an optimal mutual geometry of locating the forming rolls 21 and 22 and the forming shoe 11 so that in connection with the deck 12 and after the deck 12 of the shoe 11, sufficient space and sufficient difference in height are attained for water collecting means 40 that operate without suction. Such water collecting means collect water removed out of the web W in conjunction with the shoe 11 and through the upper wire 20. In the present invention, such water collecting means 40 are expressly used which operate without suction. In other words, the water is collected and removed on the basis of kinetic energy, and partially on the basis of gravity (arrows F).

In an area of a trailing edge of the forming shoe 11 and after this area, water collecting means 40 are fitted inside the upper-wire loop 20 in conjunction with the frame of the top wire unit 30. The water collecting means 40 comprise a water collecting trough 28 with a front wall 26 thereof situated in an area of an upper horizontal tangential plane of the forming shoe 11. A lower wall 27 of the trough 28 is situated proximate to a straight rise or run of the wires 10, 20 after the trailing edge of the deck 12 of the forming shoe 11 and, in FIG. 2, facing dry suction boxes 14. The trough 28 includes means and ducts by which the water is removed without suction to sides of the paper machine.

In the present invention, difference in height $H_0$ between a highest point of the deck 12 of the forming shoe 11 and the plane T—T of the wire 10 is relatively small. As a rule, $H_0 <$ about 400 mm. Preferably, $H_0$ is within a range of $H_0$=about 200–350 mm. Correspondingly, a lowest point of the guide sector c of the second forming roll 22 is situated below the plane T—T, the difference in height being denoted by $H_1$. As a rule, $H_1$ is within the range of $H_1$=about 300–600 mm. Preferably, $H_1$=about 400–500 mm.

By choosing differences in height $H_0$, $H_1$, a radius R of curvature of the deck 12 of the forming shoe 11, and horizontal distances of various components from one another, e.g., to be correctly proportioned relative to one another on the basis of the inventive concepts set forth herein, it is possible to accomplish the various objectives of the present invention. One of the most important objectives of this invention is the possibility of utilizing simple and low-cost water collecting means 40 which operate without suction.

A magnitude of the guide sector c situated in conjunction with the second forming roll 22 is, as a rule, within the range of c =about 20°–40°. Preferably, c is roughly equal to about 30°. Correspondingly, magnitude of a guide sector d on the guide rolls 16*a* or 16*b* is within the range of d=about 5°–50°. Preferably, d is roughly equal to about 35°.

The radius of curvature R of the guide deck 12 provided with a hollow face of the forming shoe 11 is, as a rule, within a range of R=about 2000–6000 mm. Preferably, R=about 2500–3500 mm. A central angle b of the guide deck 12 is, as a rule, within a range of b=about 20°–40°. Preferably b is roughly equal to about 30°. A length of the deck 12 in a direction of the run of the wires 10, 20 is within a range of about 1000–2000 mm., preferably within the range of about 1200–1500 mm.

According to FIG. 1, the second forming roll 22 is followed by a dry suction box 15*a* situated inside the lower loop of the wire 10, while the guide roll 16*a* is followed by three dry suction boxes 15*b* which are situated within an area of a guide roll 23 which in turn is situated inside the loop of the upper wire 20 and is provided with a drive 24. Correspondingly, according to FIG. 2, two dry suction boxes 14 are provided on a straight run of the wires 10, 20 running downwardly inclined between the forming shoe 11 and the second forming roll 22 inside the lower wire loop 10. In an area of the guide roll 23 of the wire 20, there are two dry suction boxes 15*b* in FIG. 2.

The forming shoe 11 and its guide deck 12 are preferably fitted so that the deck 12 is situated substantially symmetrically relative to a vertical plane V—V passing through a topmost point thereof as illustrated.

Before the twin-wire portion which begins at a line A and ends in an area of a line B, there is the initial single-wire portion 10*a* of the dewatering zone formed by the plane T—T of the original wire. The dewatering preferably takes place within the initial portion 10*a* by means of dewatering means belonging to the old fourdrinier former and situated between the slice (not illustrated) of a head box and the line A, such as a forming board and drainage foils (not illustrated) which do not have to be renewed. Within the single-wire initial portion 10*a*, the dewatering takes place downwardly through the lower wire 10, but preferably relatively gently so that possibilities for good formation and retention are maintained and an adequate proportion is left over for dewatering that takes place upwardly. After the line A, the joint run of the wires 10 and 20 is curved upwardly within the sector a. A magnitude of the sector a is, e.g., a=about 5°-60°, preferably a=about 20°-40°. Within the sector a, the dewatering pressure is generated by the effect of a tensioning between the wires 10 and 20, with centrifugal forces promoting the drainage of water. Within the sector a, water is removed through both of the wires 10 and 20 and upwardly into the open hollow face 21' of the roll 21.

The sector a is followed by a short straight run of the wires 10 and 20, after which the run of the wires 10 and 20 is curved downwardly on the hollow-faced deck 12 of the shoe 11. In the area of the shoe 11, the dewatering takes place by the effect of the compression between the wires 10 and 20 and by the effect of centrifugal forces, upwardly through the upper wire 20 as well as to some extent downwardly through the gaps or openings in the hollow-faced deck 12 of the shoe, assisted by the suction of the barometric leg 13 or a corresponding source of negative pressure.

The trailing edge of the deck 12 of the shoe 11 is followed by a short straight joint run of the wires 10 and 20, after which the joint run of the wires 10 and 20 is curved within the area of the second forming roll 22, namely within the sector c upwardly. Then, the roll **16*a* or 16*a* follows, on which the joint run of the wires 10 and 20 is curved downwardly with the sector d to join the original plane T—T of the lower wire 10. The twin-wire portion ends in the area of the line B. The web W is detached from the lower wire 10 on the downwardly inclined run between rolls 17, 18 by effect of a suction zone 40*a* of a pick-up roll 401, and is transferred onto a pick-up fabric 41** which in turn transfers the web W further into the press section (not illustrated).

The dewatering processes in the twin-wire 10, 20 dewatering zone will be described below in greater detail. When a web $W_0$ arrives at the beginning A of a twin-wire portion after a gentle, initial dewatering that took place through the wire 10, it has reached a suitable degree of couching. Dewatering also begins upwardly through the upper wire 10 within the sector a of the open roll 21 face 21', due to the open face 21' of the roll 21 and by the effect of compression between the wires 10 and 20. This dewatering which takes place upwardly within the sector a is not particularly intensive and continues on the curved deck 12 of the forming shoe 11 relatively gently and primarily upwardly by the effect of the centrifugal force caused by the curve radius R of the deck 12 of the shoe 11 and by the effect of the tensioning between the wires 10 and 20. As is well known thereat, the pressure p between the wires 10 and 20 is $p=T/R$ wherein T=tension of the upper wire 20. The pressure of the dewatering taking place downwardly on the sector c of the smooth-faced forming roll 22 is increased substantially. The second forming roll 22, over which a joint run of the wires 10, 20 is curved upwardly on sector c, may be a smooth-faced roll. The radius $R_0$ of the roll 22 is thereby chosen substantially smaller than the radius R of curvature of the deck 12 of the curved forming shoe 11, to increase the dewatering taking place downwardly ($R_0 << R$).

Dry suction boxes 14, **15*a* and 15*b*** are used to the extent that is necessary. However, one of the main principles of the present invention is that attempts are made to use a relatively low number of dry suction boxes, because the power consumption thereof is relatively high.

With respect to the more important different details of the embodiments illustrated in FIGS. 1 and 2, the following should be noted. The top-wire unit 30 is preferably made so that it can be shifted out of position as an entire unit, e.g. for servicing. When a fourdrinier former of a paper machine is modernized by means of a solution in accordance with FIG. 1, no substantial alterations need be made to the frame construction 100, since the forming shoe 11 and the rolls **16*a*, 16*b* can be easily placed on the existing frame 100. In other words, the present invention is especially suited for modernization of an existing fourdrinier former so as to improve the dewatering capacity of the fourdrinier former and the formation of paper while at the same time achieving good retention. The web former especially comprises the upper wire unit 30 and a guide roll 16*a* or 16*b* fitted inside the lower wire loop 10 after the second guide and forming roll 22. The joint run of the wires 10, 20 is curved and becomes substantially horizontal over the sector d of the guide roll 16*a* or 16*b*. Furthermore, an upper tangential plane of the guide roll 16*a*, 16*b* is fitted substantially at a level T—T of the original wire of the unit to be modernized. An initial dewatering zone in the modernized web former is at an initial part 10*a* of the fourdrinier wire 10** after the head box.

One feature of operation of the former illustrated in FIGS. 1 and 2 is that dewatering taking place upwardly through the upper wire 20 already begins in an area of the open-faced 21' forming roll 21, even though relatively gently at the beginning. This dewatering continues in the area of the forming shoe 11. The dewatering can be arranged on the shoe 11 so that it is increased stepwise or continuously. This can be achieved, e.g., by the radius R of curvature of the deck 12 of the forming shoe 11 becoming smaller stepwise or continuously when passing from a front edge of the deck 12 of the shoe 11 towards a rear edge thereof, in the direction of web travel. In other words, the forming shoe 11 may be provided with a foil deck 12 or with a corresponding hollow face having an invariable radius R of curvature, or a radius of curvature $R_1$-$R_2$ which becomes shorter continuously or stepwise when passing from the inlet edge of the forming shoe 11 towards its trailing edge. The hollow-faced deck 12 communicates with a suction system, e.g. with the barometric leg 13 for the purposes or controlling the dewatering.

Moreover, as there are straight runs of the wires 10 and 20 between the sectors a, b, c, and d on which dewatering pressure is suddenly lost, varying pulsation of the dewatering pressure is generated which has been noted to produce a favorable effect in the formation of the web W.

It is also important that the amount of dewatering taking place upwardly can be made adequate and adjustable, if necessary.

According to the present invention and in view of formation and retention, a favorable relative magnitude and sequence of different dewatering directions and different dewatering pressures is obtained so that good retention, formation and dewatering capacity are achieved.

Preferred examples of the different dewatering members in the web former in accordance with the present invention will be described below. As stated above, the first forming roll 21 should have a relatively open face so that dewatering can also take place upwardly through the upper wire 20. The roll 21 may be a grooved roll, a blind-drilled roll, or a through-drilled roll. Advantageously, the roll 21 is a roll which is provided with a spiral-groove coating and which is made by winding out of a profile band of which a proportion of the open face, i.e. of the grooves or holes in the entire mantle area, is preferably at least about 50%. Advantageously, this open hollow-faced roll 21 is coated with a wire sock. In some special applications, the roll 21 may be a suction roll. In other words, the first open forming roll 21 which is fitted inside the upper wire loop 20 and where the twin wire forming section begins on a sector a thereof, may be a grooved roll, a blind-drilled roll, a through-drilled roll, or any other corresponding roll such as a suction roll which is preferably coated with a wire sock and a proportion of open area in a hollow face 21' thereof being at least about 50% of the entire cylinder area of the roll.

With respect to construction of the forming shoe 11, the following has been ascertained. A deck 12 of the shoe 11 may have an invariable curve radius R, or alternatively this radius may become smaller when passing in the direction of running of the web W. The curve radius R of the shoe 11 deck 12 is, as a rule, within the range of R=about 2–6 m., preferably R=about 2.5–3.5 m.

The present invention also permits easy detaching of the web at the roll **16*a*, 16*b* and at the upper-wire 20 reversing roll 23, so that the wires 10 and 20 are clearly and easily separated and no curved decks are required for the dry suction boxes 15*b*. If there is a shortage of space, then the rolls 16*a* or 16*b* can be arranged as a separation roll in place of the wire suction roll 17**.

Once again, it should be emphasized that in the single-wire initial portion **10*a*, the dewatering can be arranged to be gentle so that possibilities for good retention are maintained. Moreover, in the single-wire area 10*a*, the amount of dewatering must not be excessively large in order that a sufficiently high proportion should be left over for the dewatering taking place upwardly through the upper wire 20. Regulation of the amounts and relative proportions of the dewatering taking place in different directions can be accomplished by chosing the openness of the faces and the radii of the rolls 21 and 22 and of the deck 12, as well as by choosing or adjusting positions and relative locations of the various parts, naturally within the scope of the limits imposed by the principal inventive concepts set forth above. The ultimate dewatering amount and distribution of fines in the web can be fine-adjusted if necessary, by means of dry suction boxes 15*b***.

The preceding description of the present invention is been merely exemplary, and is not intended to limit the scope thereof in any way.

What is claimed is:

1. A web former for a paper machine, comprising a combination of a lower wire loop forming an initial single wire part of a dewatering zone on which water is removed through the lower wire out of a web being formed by at least one dewatering member, an upper wire unit including an upper wire loop guided by guide rolls and a web-forming roll, the upper and lower wires forming a twin-wire part of the dewatering zone in which dewatering takes place substantially upwardly through the upper wire, and the web-forming roll being a first forming roll in a direction of web run, being provided with an open hollow face, and being fitted inside the upper wire loop, the twin-wire dewatering zone part beginning at the first forming roll and curving upwardly over a sector of this roll, a forming shoe fitted inside the lower wire loop and after the first forming roll in the web run direction, and guiding the twin-wire dewatering zone part, the forming shoe having a curved deck for guiding the lower wire loop with a center of curvature situated on a side of the lower wire loop, a second forming roll fitted inside the upper wire loop and after the forming shoe in the web run direction, and guiding the twin-wire part over a sector thereof, a lowest point of which is situated at a lower level than a level of the initial, single-wire dewatering part, a guide roll situated inside the lower wire loop after said second forming roll and guiding the twin-wire part over a sector of said guide roll to substantially the level of the initial, single-wire dewatering zone, means for collecting water being fitted inside the upper wire loop and between said forming shoe and second forming roll, said means operating without any external suction source and the water collecting thereof being based upon at least one of kinetic energy of water being removed and gravity, and said twin-wire part being arranged over said first and second forming rolls and said forming shoe therebetween, to effect dewatering in two directions over said sector of said first forming roll through both the upper and lower wires, both upwardly and downwardly over the curved deck of said forming shoe, and reversing principal dewatering direction of said shoe over said sector of said second forming roll, with dewatering pressure being increased thereat, after the initial dewatering has taken place through the lower wire on the initial single-wire part to an appropriate extent.

2. The combination of claim 1, wherein the initial, single wire part is substantially horizontal.

3. The combination of claim 1, wherein said curved deck of said forming shoe is hollow-faced.

4. The combination of claim 1, wherein said twin-wire part and said forming shoe are arranged with respect to one another to effect dewatering substantially upwardly at said curved, forming shoe deck, and said twin-wire part and said second forming roll are arranged with respect to one another to effect dewatering substantially downwardly at said sector of said second forming roll.

5. The combination of claim 1, wherein height of a top of said forming shoe above the level of the single-wire part is less than about 400 mm., and said lowest point of said second forming roll sector is situated at a distance of about 300 to 600 mm. below the single-wire level.

6. The combination of claim 5, wherein said height is about 200 to 350 mm and said distance is about 400 to 500 mm.

7. The combination of claim 3, wherein said forming shoe is positioned with a substantially vertical plane passing through a top of said forming shoe.

8. The combination of claim 7, wherein said forming shoe deck is substantially symmetrically positioned with respect to the vertical plane.

9. The combination of claim 1, wherein said forming shoe and guide roll are mounted on a frame of the former.

10. The combination of claim 1, wherein said first forming roll is a grooved roll, a blind-drilled roll, a through-drilled roll, or a suction roll.

11. The combination of claim 10, wherein said first forming roll is coated with a wire sock with a proportion of open area at least about 50% of an entire cylinder area of said first forming roll.

12. The combination of claim 1, wherein said curved forming shoe deck is provided with a foil structure or corresponding hollow face and has an invariable radius of curvature or a radius of curvature becoming continuously or stepwise shorter in a direction from an inlet edge to a trailing edge in the web travel direction, and said deck communicates with a barometric leg for controlling dewatering.

13. The combination of claim 1, wherein said second forming roll is positioned to curve said twin-wire part upwardly over said sector of said second forming roll, and is a smooth-faced roll.

14. The combination of claim 1, wherein a radius of curvature of said forming shoe deck is within the range of about 200 to 6000 mm.

15. The combination of claim 14, wherein said radius of curvature is within the range of about 2500 to 3500 mm.

16. The combination of claim 1, wherein a length of said forming shoe deck in the web travel direction is within the range of about 1000 to 2000 mm.

17. The combination of claim 16, wherein said length is within the range of about 1200 to 1500 mm.

18. The combination of claim 1, wherein said second forming roll sector is within a range of about 20° to 40°.

19. The combination of claim 18, wherein said second forming roll sector is equal to about 30°.

20. The combination of claim 1, wherein said guide roll sector is within the range of about 5° to 50°.

21. The combination of claim 20, wherein said guide roll sector is equal to about 35°.

22. The combination of claim 1, wherein a center of said second forming roll is positioned below said level of said initial, single-wire dewatering part, additionally comprising at least one dry suction box fitted inside the lower wire loop between the forming shoe and said second forming roll, and said twin-wire run passing directly from said second forming roll to said guide roll, without any outside dewatering devices being situated therebetween.

23. The combination of claim 1, wherein a center of said second forming roll is situated above said level of said initial, single-wire dewatering part, and additionally comprising a dry suction box fitted inside the lower wire loop between said second forming roll and guide roll.

24. The combination of claim 1, wherein said first forming roll sector is within the range of about 5° to 60°.

25. The combination of claim 24, wherein said sector is within the range of about 20° to 40°.

26. The combination of claim 1, wherein a central angle of said forming shoe deck is within the range of about 20° to 40°.

27. The combination of claim 26, wherein said central angle is equal to about 30°.

* * * * *